US006073880A

United States Patent [19]

Voigt et al.

[11] Patent Number: 6,073,880

[45] Date of Patent: Jun. 13, 2000

[54] INTEGRATED MISSILE FIN DEPLOYMENT SYSTEM

[75] Inventors: Allan A. Voigt; John M. Speicher, both of Geyserville, Calif.

[73] Assignee: Versatron, Inc., Santa Rose, Calif.

[21] Appl. No.: 09/080,483

[22] Filed: May 18, 1998

[51] Int. Cl.[7] ..... F42B 10/14

[52] U.S. Cl. ..... 244/3.28; 244/3.24; 244/49; 244/46

[58] Field of Search ..... 244/48, 49, 45 A, 244/46, 3.24, 3.28, 3.21, 89

[56] References Cited

U.S. PATENT DOCUMENTS

| | | |
|---|---|---|
| 3,102,437 | 9/1963 | Geyer . |
| 3,154,015 | 10/1964 | Muller . |
| 4,029,270 | 6/1977 | Niemeier . |
| 4,659,037 | 4/1987 | Uterstein . |
| 4,667,899 | 5/1987 | Wedertz . |
| 4,709,877 | 12/1987 | Goulding . |
| 5,240,203 | 8/1993 | Myers . |
| 5,950,963 | 9/1999 | Speicher et al. . |
| 5,975,461 | 11/1999 | Ulrich . |

FOREIGN PATENT DOCUMENTS

| | | | |
|---|---|---|---|
| 1055003 | 5/1926 | Canada | 244/3.24 |
| 252433 | 5/1926 | United Kingdom | 244/3.24 |

*Primary Examiner*—Peter M. Poon
*Assistant Examiner*—Tien Dinh
*Attorney, Agent, or Firm*—Henry M. Bissell

[57] ABSTRACT

Pairs of aerofins used for stabilization and control of missile flight are deployed through shared longitudinal slots provided in the missile body. Before launch, the pairs of aerofins, each pair comprised of a canard and a deflector, are retained in a folded position by a releasable latch mechanism within the missile body. The deflectors are mounted in a laterally displaced position from the longitudinal slots and are constrained from sliding into alignment with the slots by the presence of the folded canards. When the canards are released by the latch mechanism and permitted to extend outward to their deployed positions, the deflectors are able to laterally shift, effectively displacing the canards in the alignment position and subsequently deploying. The latch mechanism is designed to simultaneously release all the canards following missile launch, with biasing torsional springs operating to urge the canards outward through the associated slots to the extended position upon release. The deflectors are also provided with biasing springs, with these springs providing not only torsional force for urging the deflectors outward, but also compressional force to effect the lateral shifting of the deflectors. The latch mechanism is activated by an actuation mechanism when the missile has cleared the launch tube or other launch facility.

23 Claims, 6 Drawing Sheets

46a
12a 14a
4
3
10
34a
36a
38a
60
5
40
5
42
13
16
20
44
56d
46
12c
14c
34c
38c
36c
12c'
3
4
14c'

12b'
14b'
10
10
140a
142a
60'
34b
146
60'
140b
142b
144b
10
14d'
12d'

INTEGRATED MISSILE FIN DEPLOYMENT SYSTEM

BACKGROUND OF THE INVENTION

1. Field of the Invention

The invention relates to aerofin stabilized and controlled missiles, and more particularly, to a mechanism for the deployment of folded aerofins following missile launch.

2. Description of the Related Art

Small guided missiles typically have various subsystems which are required for the mission. These subsystems include major subcomponents, such as the rocket motor and warhead, upon which missile performance is critically dependent. Maximizing the size of these subcomponents increases the range of the missile and enhances its performance. It is therefore an advantage to design the remaining necessary components, such as the control and guidance systems, to be as small as practicable so that the rocket motor and warhead can be as large as possible, thereby extending the range and effectiveness of the missile.

In many cases it is an advantage to use large aerodynamic fins for missile control. A multiplicity of these fins may be employed, with eight being a typical number. Depending on the missile, some or all the fins may be rotatable, providing missile steering control in any combination of directions along the yaw, pitch and roll axes. The fins, according to the sophistication of the missile and the requirements of the anticipated conditions, may be independently or jointly controllable to provide the maneuverability demanded by modern warfare applications.

Prior to launch, the fins are folded in order to permit better handling and accommodation by launch equipment such as a launch tube. When the missile is launched, the folded fins are erected from the folded position to an extended position and operate to provide control and stabilization of the missile during flight. When deployed, the fins extend from the interior of the missile body, where they are pivotably mounted, to the exterior of the missile body through longitudinal slots provided in the missile body. Typically, the number of slots corresponds to the number of aerofins, and in an application using eight aerofins, eight such slots are provided.

A drawback of the use of folding aerofins is attributable to the longitudinal slots through which the fins are deployed. The slots compromise the integrity of the missile, weakening the airframe structure. Moreover, with each slot, associated aerodynamic drag is introduced, detracting from the range and efficiency of the missile and compromising overall missile performance.

SUMMARY OF THE INVENTION

The invention overcomes certain deficiencies of the prior art by minimizing the number of slots required for deployment of the missile aerofins. According to the invention the slots are designed to be shared by the aerofins, with pairs of aerofins being deployed through common longitudinal slots. This effectively reduces the number of required slots by half, enhancing the structural integrity of the missile and reducing aerodynamic drag. In addition, using an aerofin control surface comprised of fixed and moveable portions allows reduced torque on the actuators required to rotate the control surfaces.

Each pair of aerofins is comprised of the main aerofin, referred to as the canard, and the secondary aerofin, referred to as the deflector, with the deflector being disposed forward of the canard along the missile body. Prior to deployment, the canard and deflector of each pair are retained in the folded position within the missile such that only the canard is in alignment with the associated longitudinal slot through which the canard and deflector are to be deployed. The canard, retained in the folded position by a latch mechanism, in turn serves to constrain the deflector within the missile by keeping the deflector out of alignment with the slot. When the canard is released by the latch mechanism, a biasing force provided by a spring urges it rotationally through the longitudinal slot to the extended position. Subsequently, the deflector, no longer constrained by the canard, shifts transversely to an alignment position with the shared longitudinal slot, with a biasing force provided by a second spring then urging it rotationally through the slot to the extended position. This second spring also provides the compressional force which effects the transverse positional shift of the deflector from the non-alignment to the alignment positions. In this manner, the single latch mechanism simply and efficiently triggers deployment of both the canard and deflector.

To further improve missile performance, missile weight is reduced and interior space more effectively utilized by use of a unique, integrated latch mechanism which simultaneously deploys all the folding canards and deflectors. The latch mechanism is comprised of a plate having a series of latch arms each corresponding to an associated canard. The latch arms engage the canards at suitably provided notches disposed on the canards to retain them in the folded position within the missile, while the canards retain the deflectors out of alignment with the slots. Upon disengagement of the latch mechanism, the canards are simultaneously released from the folded position to the extended position, in turn permitting simultaneous shifting of the deflectors from the non-alignment to the alignment positions and their consequent deployment. Hence a single mechanism simultaneously releases all the canards and deflectors in a unique and efficient manner.

Movement and disengagement of the latch mechanism is effected by a suitable actuation mechanism such as an electromechanical or pyrotechnic device. A tab provided on the latch plate facilitates engagement with the actuation mechanism. A simple timer, or a command signal or other mechanism triggered upon the missile's clearing the launch tube or the appropriate launch facility may be provided to activate this actuation mechanism.

Some or all of the canards may be equipped with drive motors to effect their axial rotation, once they are deployed, in order to impart steering forces to the missile during flight. Any combination of axial motions for these canards, referred to as variable incidence canards, may be achieved using linked or independent drive mechanisms. For example, a pair of opposing canards can be mounted to a common drive shaft linked to a single motor to effect their motion in unison. Alternatively, each variable incidence canard may be provided with its own drive motor. Other combinations, such as a three-aerofin design, are also possible in order to accomplish motions along the yaw, pitch and roll axes.

BRIEF DESCRIPTION OF THE DRAWINGS

A better understanding of the present invention may be realized from a consideration of the following detailed description, taken in conjunction with the accompanying drawings, in which:

FIG. 4 is a schematic cross-sectional view of the missile taken at the plane 4—4 of FIG. 2 with the aerofins retracted in stored position and showing the biasing and mounting means of the aerofins according to a first embodiment of the invention;

DESCRIPTION OF THE PREFERRED EMBODIMENTS

Figure 1:
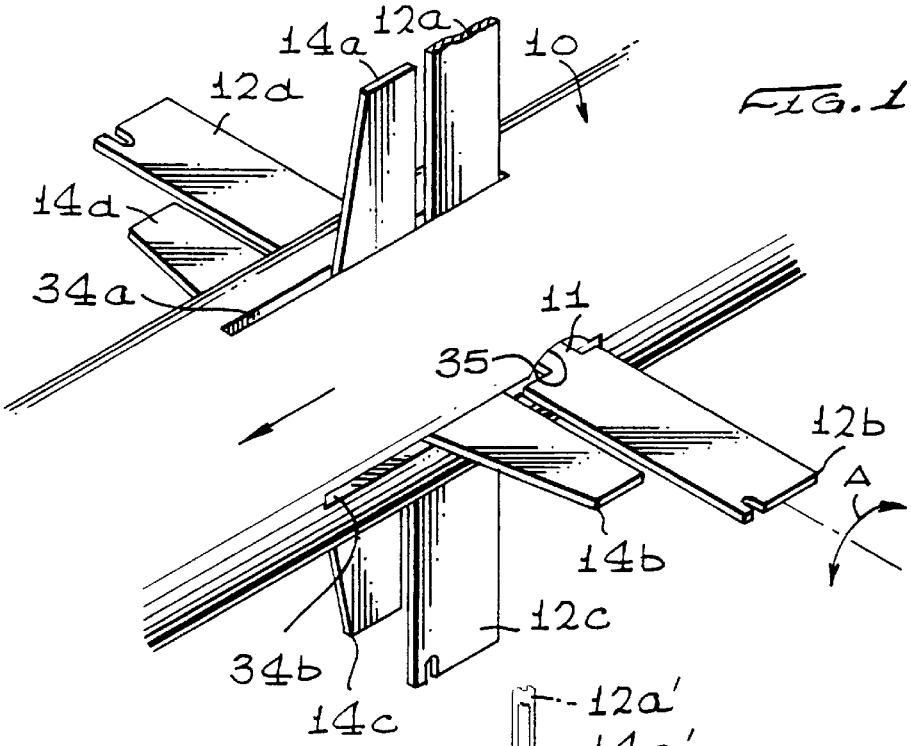
FIG. 1 is a perspective view of a section of a missile embodying the invention and showing deflector and canard aerofins in the extended position.

FIG. 1 schematically illustrates a segment of a missile 10 in flight having aerofins deployed in accordance with the invention. The aerofins 12, 14 of the missile are deployed and operate to effect stabilization and, in some embodiments, steering control of the missile in its flight path. The aerofins are paired, with each pair being comprised of a canard 12 and deflector 14 which extend through a shared slot 34 from the interior of the missile to its exterior for interaction with the airstream during flight. As depicted in the drawings, deflectors 14 are forward of canards 12. Depending on the embodiment, some or all of the canards 12 may be mounted for axial rotation, as indicated by curved arrow A, in order to effect steering control of the missile in the yaw, pitch and roll axes. These canards 12 may be linked together for synchronized rotation or they may be independently controlled.

Prior to deployment, the canards 12 and deflectors 14 are folded within the missile body. Anchored at fold hinge pins 36 and 38, respectively, the canards 12 and deflectors 14 swing out to their extended positions following missile launch. Torsional springs 30, 32 serve to urge the canards and deflectors toward the extended positions.

Figure 3:
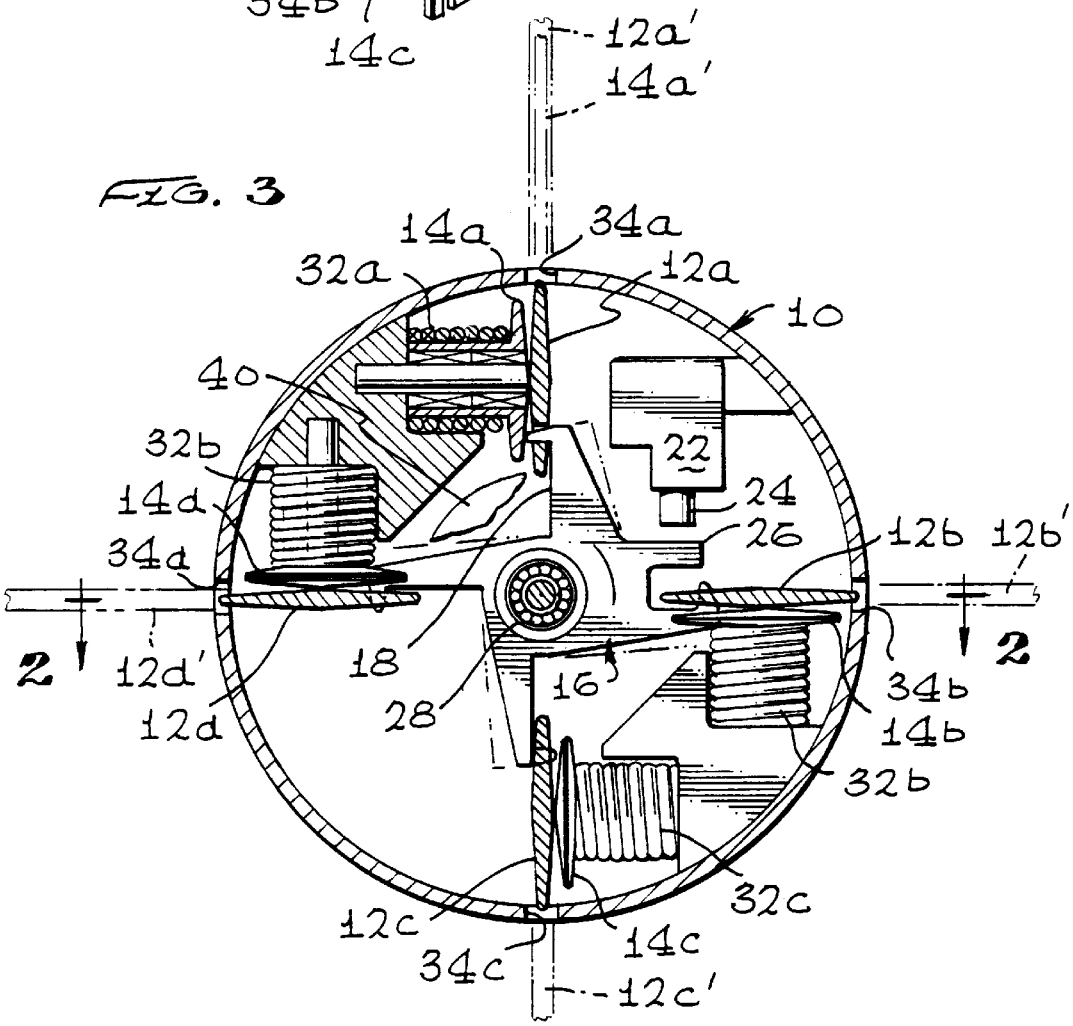
FIG. 3 is a schematic cross-sectional view of the missile taken at the plane 3—3 of FIG. 2 looking in the direction of the arrows and showing the latch mechanism of the invention.
Figure 2:
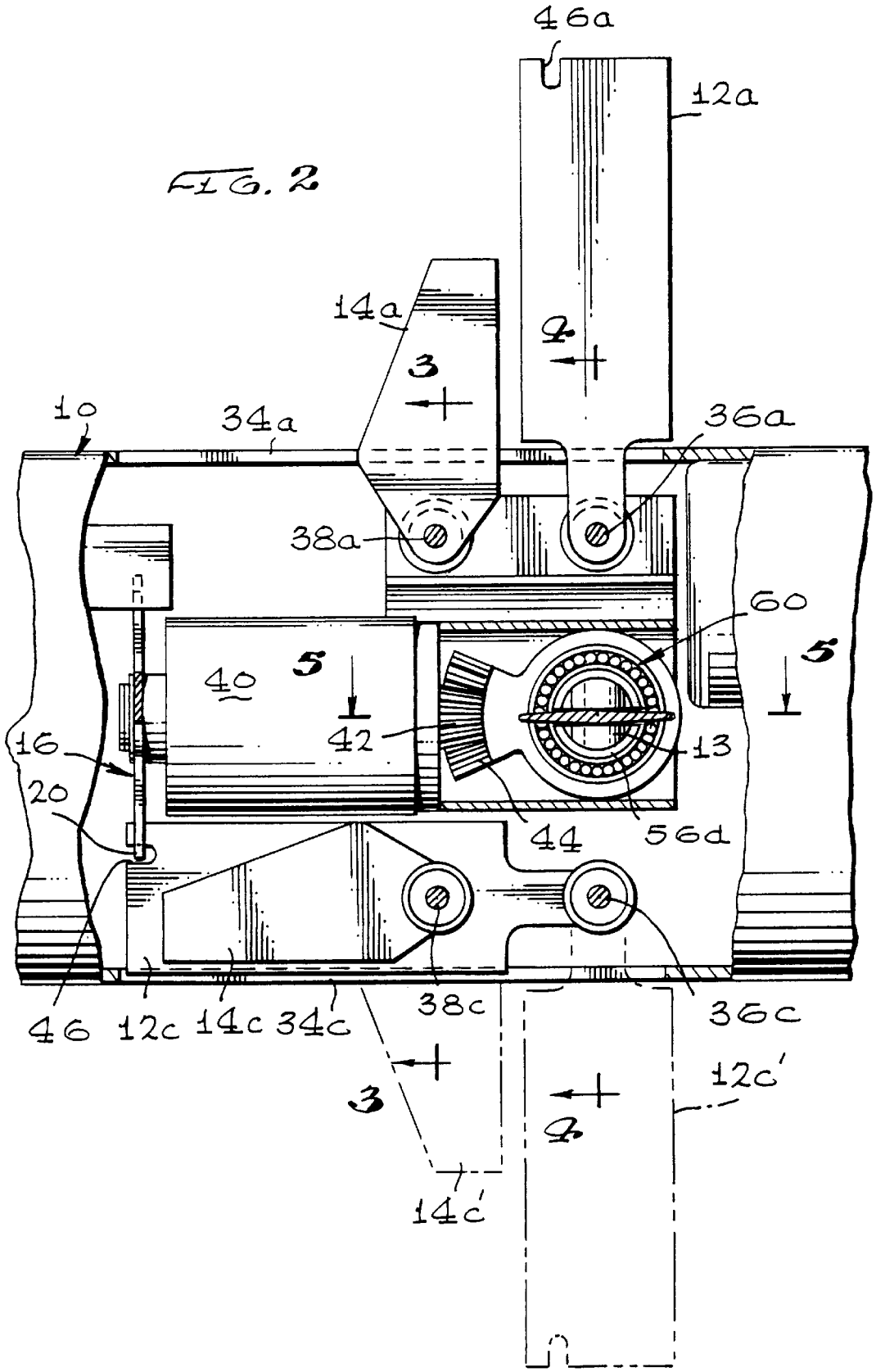
FIG. 2 is a schematic view, partially cut-away along the lines 2—2 of FIG. 3, showing certain deflectors and canards in both extended and folded positions.

The unique arrangement for folding the aerofins within the missile body preceding launch and for deploying the aerofins following launch is depicted in FIGS. 2 and 3. Numerals 12*c* and 14*c* delineate, respectively, a canard and deflector in a folded state, while phantom lines 12*c*' and 14*c*' show these components in the deployed state. As seen in FIG. 3, in the folded positions, only the canards 12 are normally in alignment with the longitudinal slots 34. The deflectors 14, by contrast, are laterally displaced from the longitudinal slots 34 and constrained from moving to alignment with the slots 34 by the canards 12.

The canards 12 are retained in place, against the biasing force of torsional springs 30 (FIG. 4) urging them outward, by a latching mechanism 16 having radially extending arms 18 whose distal ends are provided with hooks 20. The motor 40 is shown partially broken away in FIG. 3 in order to render the latching mechanism 16 visible. These hooks 20 engage notches 46 formed on the ends of the canards 12 and serve to retain the canards within the missile in the folded position. Springs 30, in this folded configuration, are in a loaded state.

Latching mechanism 16 is rotatably mounted within the missile at a bearing 28 as illustrated in FIG. 3. A rotational force applied thereto, which in FIG. 3 would be in a clockwise direction, disengages hooks 20 from notches 46, thereby releasing the energy of springs 30 and causing canards 12 (four in this embodiment) to simultaneously swing outward, through longitudinal slots 34, to the extended positions outside the missile 10.

Figure 6:
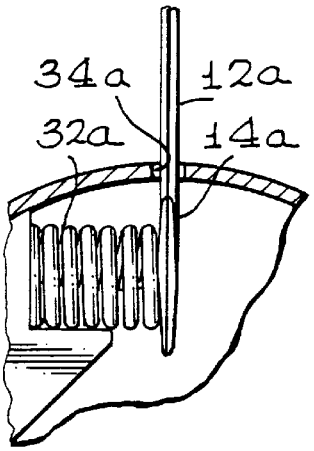
FIG. 6 is a sectional view of a portion of the missile showing a deflector after shifting into position for erection of an associated canard.

With canards 12 no longer obstructing deflectors 14, the deflectors can shift laterally along fold hinge pins 38 to thereby replace the canards 12 in the now vacant alignment positions. This intermediate configuration of the missile fin deployment sequence is depicted in FIG. 6. The lateral shift of deflectors 14 is driven by springs 32 associated with each deflector, the springs 32 providing both compressional force for driving this lateral motion and torsional force for driving rotational motion of the deflectors 14. The rotational motion becomes possible upon shifting of deflectors 14 into alignment with slots 34 after deployment of the canards and serves as the last step in the integrated deployment process contemplated by the unique mechanism of the invention. The deflectors 14, once in alignment with the slots 34, are able to swing outward into the extended positions outside the missile body for interaction with the airstream and stabilization of the missile during flight. Hence by a single mechanical configuration, simultaneous release and deployment of all the canards 12 and deflectors 14 are efficiently and speedily effected.

Mechanically, the release process begins with activation of device 22 (FIG. 3) which imparts a rotational force to latching mechanism 16. Device 22, which can be a pyrotechnic actuator or some other mechanical or electromechanical source, is mechanically linked, through a piston 24 bearing against arm 26, to the latching mechanism and provides the rotational force which drives the latching mechanism. Activated by an appropriate signal, device 22 is deployed upon successful completion of the launch stage of the missile flight, and may be responsive to a timer or sensor which ensures that the missile has cleared the launch facility before initiating deployment of the aerofins. This timing aspect of the invention is particularly advantageous when the missile is to be launched from a launch tube.

To effect steering control of the missile 10, some or all of the canards 12 can be mounted for axial rotation as indicated by arrow A in FIG. 1. The fold hinge pins 36 about which the canards 12 swing from the folded position to the deployed position may be transversely mounted in rotatable bearing shafts 56, each associated with an axially rotating canard 12. As FIG. 2 illustrates, the base of each canard 12 forms a boss cylinder 13 through which the fold hinge pin 36 extends. A spherical radius is provided for the base 13 to facilitate transverse rotation within the bearing shaft 56 during the rotational deployment motion. In addition, to permit uninhibited axial rotation of the canards 12 once they are extended, the canards may be thinned (region 11) and the slots 34 themselves widened in the region 35 where the canards pass through the slots 34. This is best illustrated in FIG. 1.

In order to accommodate the canards 12 in the folded position in the bearing shafts 56, axially-extending slots 58 (FIG. 5) are provided in the outer portion of each bearing shaft 56. When extended, the canards 12 are co-axial with bearing shafts 56, and rotation of the bearing shafts thus effects a commensurate axial rotation of the canards 12.

Figure 5:
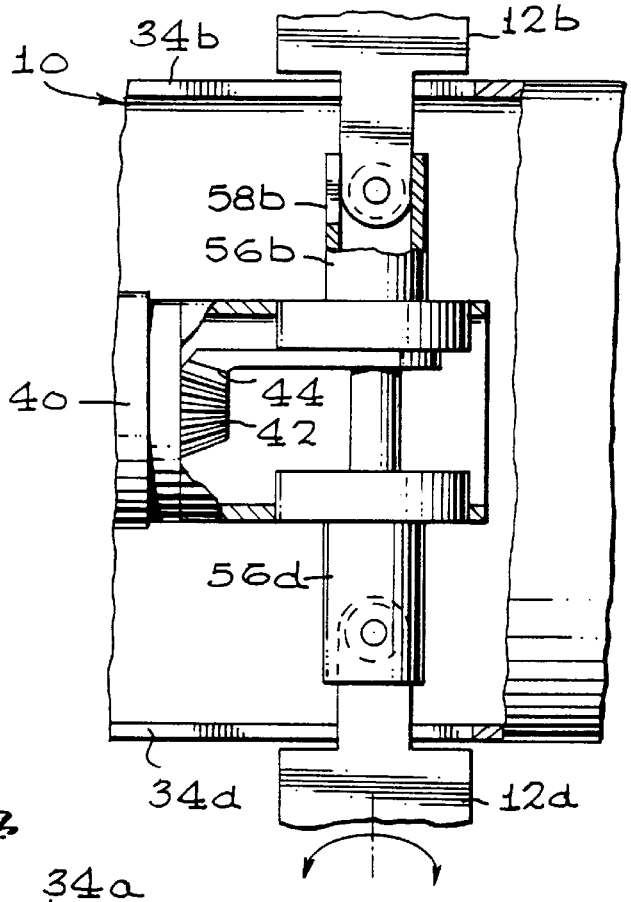
FIG. 5 is a schematic partial cut-away view taken along line 5—5 of FIG. 4 and showing the control scheme for a pair of axially rotatable canards mounted on a common shaft.

As seen in the drawing figures, particularly FIGS. 2 and 5, rotation of the bearing shafts 56 is effected by means of a centrally mounted control actuator motor 40. A gear linkage, comprised of beveled shaft gear 42 in engagement with a sector gear 44, serves to transfer rotational motion of motor 40 to bearing shaft 56, which is rotatably mounted in bearing 60.

Figure 10:
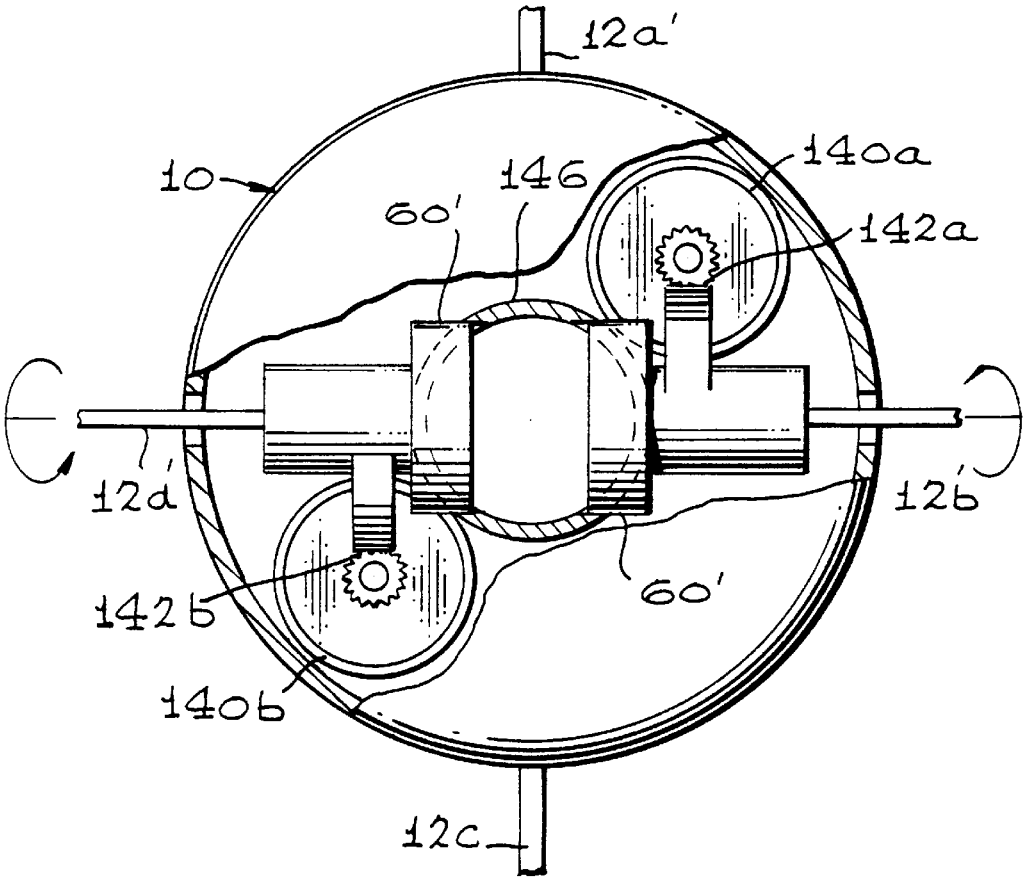
FIG. 10 is a schematic partial sectional view corresponding to that of FIG. 7 but showing the drive arrangement for still another embodiment of the invention.
Figure 11:
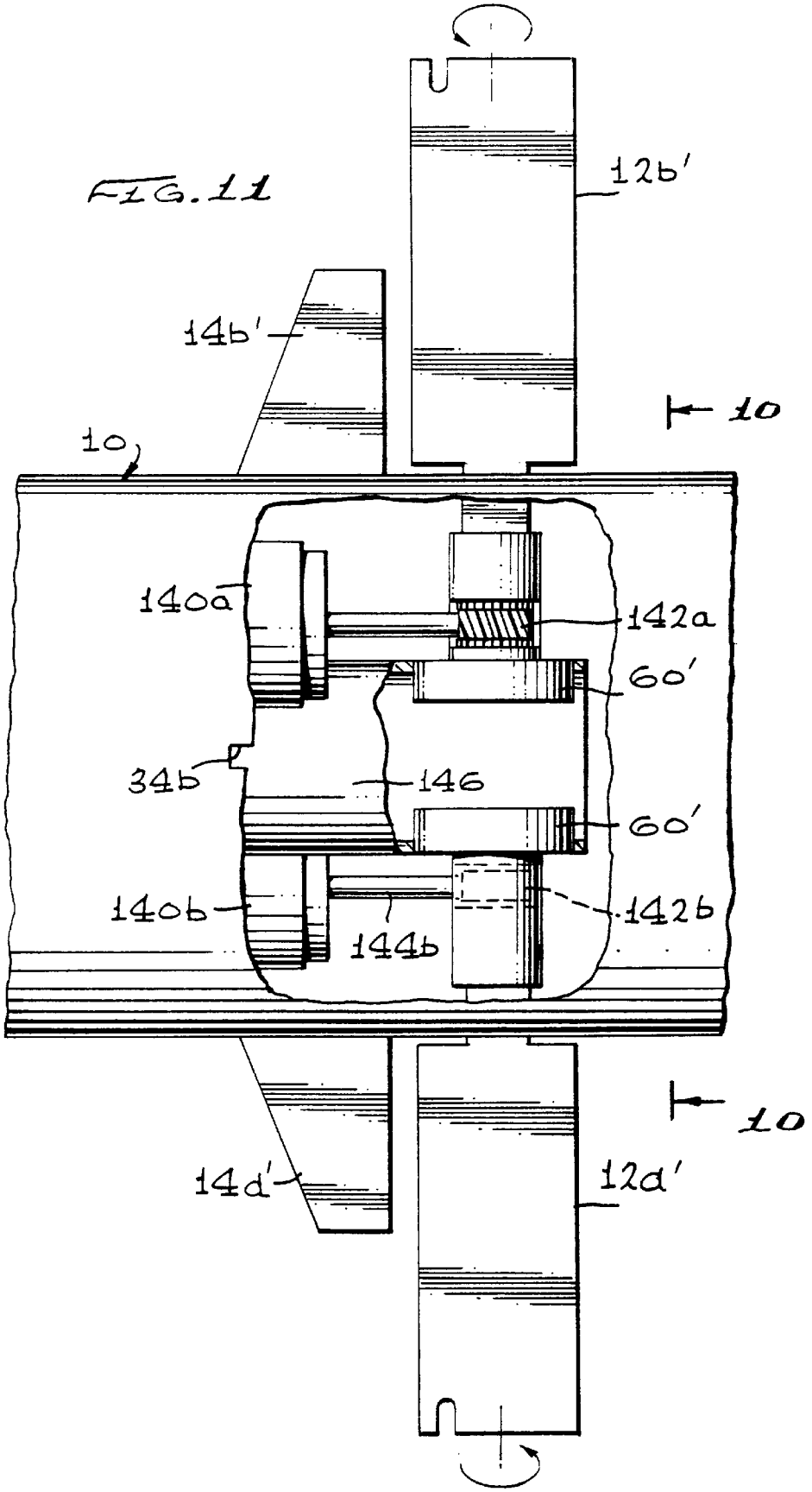
FIG. 11 is a schematic partial cut away view showing the drive arrangement of the embodiment of FIG. 10.

For independent rotation of canards 12, a motor, gearing mechanism, and bearing shaft may be provided for each canard 12. This is represented in the schematic sectional views of FIGS. 10 and 11 wherein canards 12*b*' and 12*d*' are independently supported in bearings 60', for independent rotation by two separate motors 140*a*, 140*b* coupled respectively through the worm gears 142*a*, 142*b* to the respective canards 12*b*', 12*d*'. A frame member 146, sectioned in FIG. 10 and partially cut away in FIG. 11, is shown as providing support for the individual bearings 60'.

Figure 8:
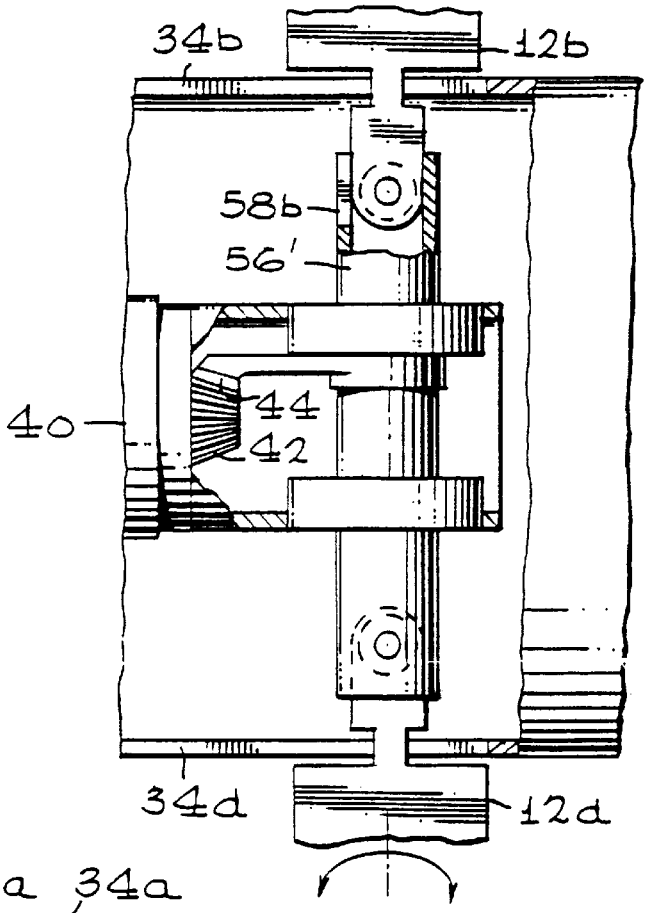
FIG. 8. is a schematic partial cut-away view taken along line 8—8 of FIG. 7 and showing the control scheme for a pair of axially rotatable canards mounted on individual shafts for independent rotation.
Figure 7:
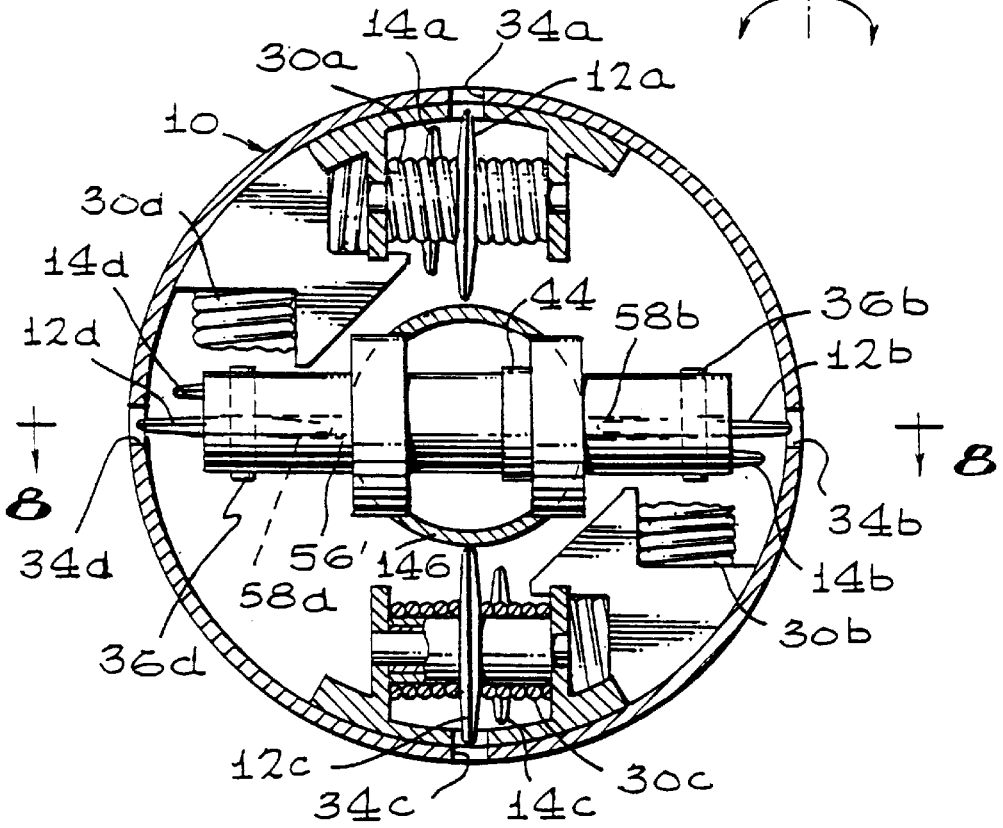
FIG. 7 is a schematic cross-sectional view of the missile showing the biasing and mounting means of the aerofins according to a second embodiment of the invention.
Figure 9:
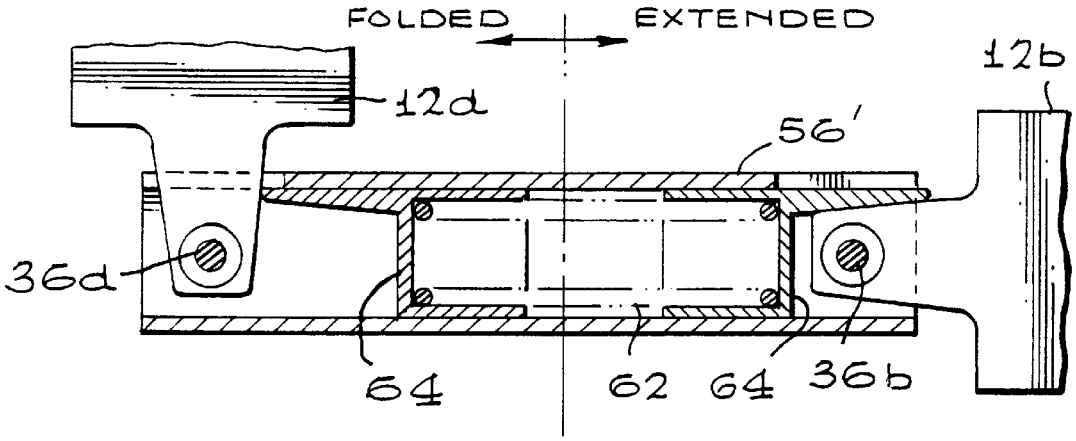

Alternatively, when synchronous rotation of opposing canards is desired, the canards may be mechanically linked and some attendant components may be shared. Specifically, FIGS. 7 and 8 illustrate a situation in which canards 12*b* and 12*d* are to be rotated in unison. In this configuration, there two canards can only control missile movements in the yaw or pitch axis. Motion in the roll axis, if desired, may be effected using the independent axial rotation of one pair of opposed canards (e.g., canards 12*b*' and 12*d*' as shown in FIGS. 10 and 11). FIGS. 10 and 11 have been drawn to show the independent axial rotation of the opposed canards 12*b*', 12*d*' only. Details of the canard extension mechanism, such as are shown in FIG. 4, for example, have been omitted for simplicity of presentation. It will be understood, however, that to be complete the embodiment of FIGS. 10 and 11 includes the various torsional and compression springs with related structure such as is shown in FIGS. 3 and 4.

In accordance with FIGS. 7 and 8, a single bearing shaft 56' extends from side to side across the missile, mounting two canards, one on each end, for axial rotation therewith. Rotation of the bearing shaft 56' itself is effected in the same manner as the other embodiments, with a single sector gear 44 engaging centrally mounted control actuator motor 40 via beveled shaft gear 42 as described above.

Figure 9:
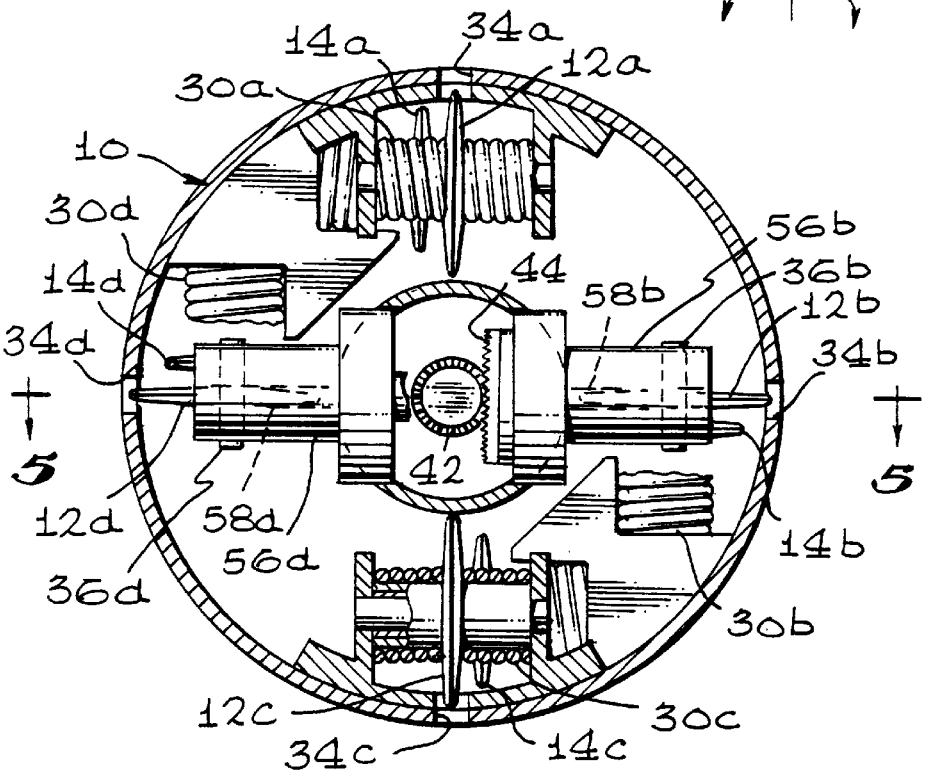
FIG. 9. is a schematic sectional view, partially cut-away, of a biasing arrangement for the aerofins.

As an alternative to the torsional springs 30, compression springs can be provided within the bearing shafts 56, with these compression springs urging the canards 12 to the extended position by force against pistons connected to the canards 12. In the single bearing shaft embodiment of FIGS. 7 and 8, one such compression spring may be used to provide the necessary biasing force for both canards 12. Details of this scheme are depicted in FIG. 9, which shows a single compression spring 62 biasing pistons 64 against the canards 12 to thereby urge the canards toward the extended position and lock them in place, once extended.

Although there have been described hereinabove various specific arrangements of an integrated missile fin deployment system in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An integrated aerofin release system for a missile comprising:

a missile body having a plurality of longitudinal slots formed therein;

a canard associated with each longitudinal slot, said canard being pivotably mounted within said missile body and capable of rotation from a folded canard position within said missile body to an extended canard position extending through said associated longitudinal slot to the exterior of said missile body;

a deflector associated with each longitudinal slot, said deflector being pivotably mounted within said missile body and capable of rotation from a folded deflector position within said missile body to an extended deflector position extending through said associated longitudinal slot to the exterior of said missile body;

first biasing means for biasing the canard toward said extended canard position;

second biasing means for biasing the deflector toward said extended deflector position;

latch means for retaining said canard in said folded canard position; and actuation means for disengaging said latch means to release said canard toward said extended position.

2. The system of claim 1 further including means for mounting said canard in a position blocking rotation of the associated deflector until after said canard is rotated out of its folded canard position.

3. The system of claim 1, wherein said second biasing means is adapted to translate said deflector from a non-alignment position to a position of alignment with its associated longitudinal slot, said canard inhibiting said translation when said canard is in said folded canard position.

4. The system of claim 3, wherein said deflector is pivotably mounted for rotation about a bearing axis, said second biasing means providing both compression force for translating said deflector axially along said bearing axis and torsional force for rotating said deflector about said bearing axis from said folded deflector position to said extended deflector position.

5. The system of claim 1, wherein said latch means comprises a rotatably mounted plate having a plurality of latch arms each associated with a corresponding canard and adapted to retain said corresponding canard in said folded canard position.

6. The system of claim 1, wherein said missile is provided with a drive means for axially rotating at least two of said canards when in the extended canard position, each of said at least two canards being axially rotatable when extended and being mounted for rotation to said extended canard position about a pivot pin mounted transversely in a bearing cylinder, said bearing cylinder engaging said drive means and adapted to rotate axially in response to rotation of said drive means.

7. The system of claim 6 further including means coupling said two canards to a common drive motor for rotating said two canards in the extended position to develop steering forces on said missile.

8. The system of claim 6, wherein said drive means comprises a first, centrally mounted motor adapted to rotate a sector gear mounted on a bearing cylinder, said bearing cylinder being rotatably mounted transversely in said missile and having a first end at which a first axially rotatable canard is mounted and a second end at which a second axially rotatable canard is mounted.

9. The system of claim 6 further including means coupling two canards individually to a pair of drive motors for rotating said two canards in the extended position to develop steering forces on said missile.

10. The system of claim 9, wherein said pair of drive motors and the individual coupling means to the associated two canards are independently rotatable to develop steering forces on said missile about the roll axis.

11. The system of claim 6, wherein said drive means comprises a plurality of motors each associated with an axially rotatable canard and adapted to provide axial rotation of said axially rotatable canard independent of rotation of other axially rotatable canards.

12. The system of claim 5, wherein each said canard is provided with a notch for engaging an associated latch arm.

13. The system of claim 5, wherein said actuation means rotates said latch means to a releasing position when activated.

14. The system of claim 5, wherein a tab is provided on said latch means for engagement with said actuation means.

15. The system of claim 1, wherein said actuation means is a pyrotechnic device.

16. The system of claim 1, wherein said actuation means is an electromechanical device.

17. The system of claim 15, wherein said actuation means is activated by a signal from a timer.

18. The system of claim 15, wherein said actuation means is activated by a signal from a missile guidance computer.

19. The system of claim 16, wherein said actuation means is activated by a signal from a missile guidance computer.

20. The system of claim 16, wherein said actuation means is activated by a signal from a timer.

21. The system of claim 1, wherein said missile is adapted for launch from a launch tube, said actuation means being activated when said missile clears said launch tube following said launch.

22. The system of claim 1, wherein said first biasing means comprises a torsional spring.

23. The system of claim 1, wherein said first biasing means comprises a compression spring and piston assembly.

* * * * *